US006973877B2

(12) United States Patent
Jensen

(10) Patent No.: US 6,973,877 B2
(45) Date of Patent: Dec. 13, 2005

(54) METHOD AND APPARATUS FOR DERIVING AND IMPLEMENTING ONE OR MORE MOTION PROFILES

(75) Inventor: James B. Jensen, Woodburn, OR (US)

(73) Assignee: Xerox Corporation, Stamford, CT (US)

( * ) Notice: Subject to any disclaimer, the term of this patent is extended or adjusted under 35 U.S.C. 154(b) by 65 days.

(21) Appl. No.: 10/752,407

(22) Filed: Jan. 6, 2004

(65) Prior Publication Data

US 2005/0147443 A1 Jul. 7, 2005

(51) Int. Cl.[7] ..... B41F 1/54; B41F 1/66
(52) U.S. Cl. ..... 101/483; 101/484
(58) Field of Search ..... 101/484, 425, 101/91, 483; 318/696; 347/103

(56) References Cited

U.S. PATENT DOCUMENTS 5,225,757 A 7/1993 Burke
5,953,034 A * 9/1999 Salomon et al. ..... 347/103
6,101,945 A * 8/2000 Hara et al. ..... 101/486
6,499,400 B2 * 12/2002 Onuma et al. ..... 101/477
6,543,348 B2 * 4/2003 Onuma et al. ..... 101/142

* cited by examiner

*Primary Examiner*—Andrew H. Hirshfeld
*Assistant Examiner*—Marissa Ferguson
(74) *Attorney, Agent, or Firm*—Fay, Sharpe, Fagan, Minnich & McKee, LLP

(57) ABSTRACT

A method for deriving and implementing one or more motion profiles is provided. In the method, at least one time constraint between a first motor controlled system in an automated device and a second motor controlled system in the automated device are identified. Known parameters of the first motor controlled system and the second motor controlled system are identified and supplied. A first motion profile for the first motor controlled system is created. A second motion profile for the second motor controlled system is created. The identified at least one time constraint is applied to the first and second motion profiles to constrain the first and second motion profiles to one another. The first and second motion profiles are solved to complete a solution having solution information to prepare for use by said first and second motor controlled systems. The solution information is post-processed for use by the first and second motor controlled systems.

19 Claims, 10 Drawing Sheets

METHOD AND APPARATUS FOR DERIVING AND IMPLEMENTING ONE OR MORE MOTION PROFILES

BACKGROUND

The present application relates to a method and apparatus for controllably driving the motion of one or more masses and, more particularly, relates to a method and apparatus for deriving and implementing one or more motion profiles, e.g., position and velocity profiles, for one or more masses driven, for example, by a servo or stepper motor. The method and apparatus are particularly applicable to printer devices and will be described with particular reference thereto. However, it is to be appreciated that the method and apparatus described herein may relate to other environments and applications.

Drive means, including servo motors and stepper motors, are conventionally employed in a variety of automated devices including printing devices. Such devices often require generally incremental displacements of one or more masses contained therein to perform certain functions. For example, in some printing devices, the one or more masses can include a print drum, a printer head, a drum maintenance roller and a transfix roller.

To control one of these masses, a distinct motion profile is normally conveyed to the drive means or motor connected to the mass and, more particularly, to a motor controller that controls the motor. In the case of a rotating mass controlled by a motor (such as a print drum), using the motion profile, the motor generates rotational output to move the mass to desired positions at desired velocities over a period of time. Some devices may include multiple motors for driving multiple masses which may require multiple motion profiles and sometimes interrelated multiple motion profiles to be provided to the multiple motors. For example, printer devices have multiple masses driven by multiple motors and often require multiple motion profiles for controlling print drums, printer heads, drum maintenance rollers, transfix rollers, other moving printer device masses and the like which are typically interrelated to one another.

More specifically, functions or events performed by some printer devices require the various moving masses therein to be appropriately synchronized with one another. For example, the print drum and the print head may work together to apply a printed image on the print drum, the print drum and the transfix roller may work together to properly position a sheet of print media and transfer the image from the print drum to the sheet of print media, and the print drum and the drum maintenance roller may work together to clean the print drum prior to application of a subsequent image by the print head. Often, the precise position and velocity of each of the printer device components is not important by itself but, rather, only in relation to the other printer device components.

Heretofore, hand-coded equations were often used to construct the motion profiles of the one or more moving mass components of automated devices including printer devices. Specifically, hand-coded equations are used to construct motion profiles through software structures and sequences. One problem with the use of hand-coded equations is that the re-usability of a particular motion profile is often unavailable. More particularly, hand-coded equations often make it very difficult to change the shape and/or nature of a particular motion profile without completely revamping the entire motion profile. In addition, the programming of the motor or motors used to drive the moving mass components is very error prone and the precise errors in need of correction are often difficult to identify. Thus, there is a need for a method and apparatus that more easily allows motion profiles to be derived or developed, refined, varied and implemented.

BRIEF SUMMARY

A method for deriving and implementing one or more motion profiles is provided. More particularly, in accordance with one aspect of the method, at least one time constraint between a first motor controlled system in an automated device and a second motor controlled system in the automated device is identified. Known parameters of the first motor controlled system and the second motor controlled system are identified and supplied. A first motion profile for the first motor controlled system is created. A second motion profile for the second motor controlled system is created. The identified at least one time constraint is applied to the first and second motion profiles to constrain the first and second motion profiles to one another. The first and second motion profiles are solved to complete a solution having solution information to prepare for use by said first and second motor controlled systems. The solution information is post-processed for use by the first and second motor controlled systems.

DETAILED DESCRIPTION

Figure 1:
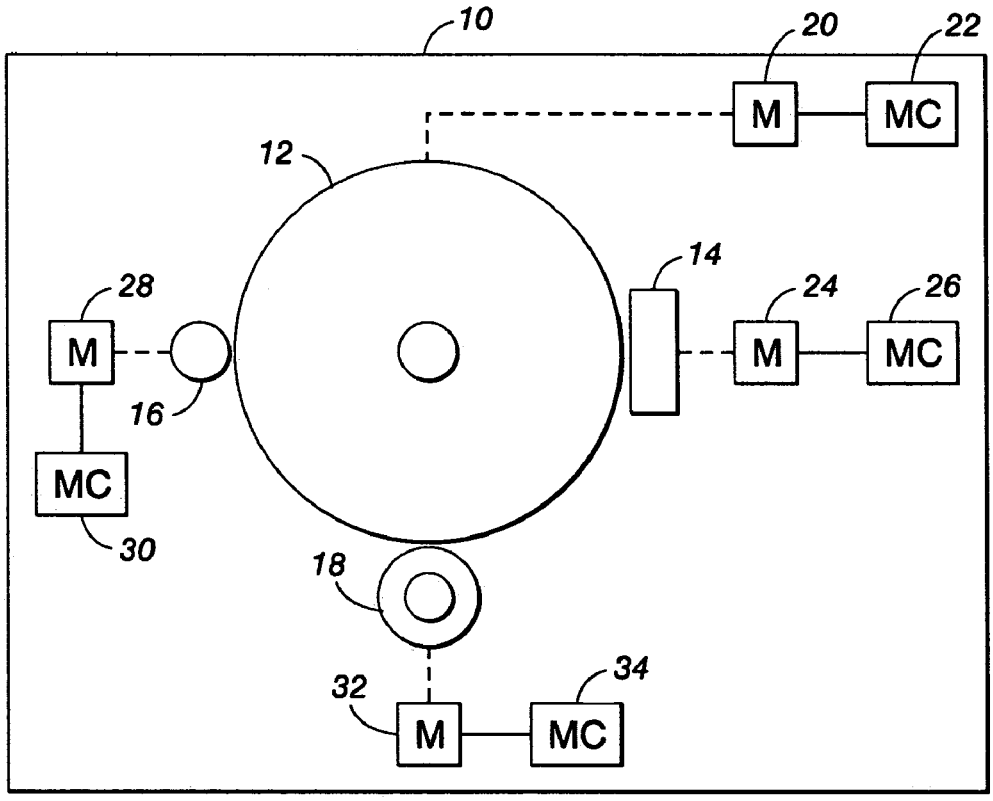
FIG. 1 is a schematic view of a printer device.

An automated device often employs one or more drive means, such as servo motors and stepper motors, to move one or more massed contained in the automated device. Often, the one or more masses contained therein are moved by the drive means in generally incremental displacements to perform certain functions. For example, with reference to FIG. 1, a printer device 10 has one or more masses including a print drum 12, a printer head 14, a drum maintenance roller 16 and a transfix roller 18 that are incrementally moved to perform certain printing and transferring functions in accordance with one embodiment.

To precisely control the movements of these masses, a motor controller (MC) connected to the motor (M) of one particular mass receives and processes a given motion profile to direct the output motion or movements of the motor. As used herein, "motor controller" is used to represent physical motor controllers and logic motor controllers within a single physical motor controller. For example, with reference again to FIG. 1, the print drum 12 is connected a print drum motor 20 having a print drum motor controller 22; the printer head 14 is connected to a print head motor 24 having a print head motor controller 26; the drum maintenance roller 16 is connected to a drum maintenance motor 28 having a drum maintenance motor controller 30; and the transfix roller 18 is connected to a transfix roller motor 32 having a transfix roller motor controller 34. Thus, specific motion profiles are conveyed to the motor controllers 22,26, 30,34 for controlling the motion of the components 12–18 driven by the motors 20,24,28,32 of the corresponding motor controllers.

In many automated devices employing multiple motors and/or multiple moveable masses driven by motors, including the printer device 10 of the embodiment described herein, the various moving masses are required to be synchronized with one another for proper operation of the automated device. For example, in the printer device 10, the print drum 12 has to be at a first specified position when the drum maintenance roller 16 engages the print drum 12, the print drum 12 has to be at a second specified position and specified velocity when the printer head 14 begins applying an image to the print drum 12 and the print drum 12 has to be at a third specified position when the transfix roller 18 engages the print drum 12. Thus, the position and velocity of each of the printer device components 12–18 are interrelated to the position and/or velocity of the other of the printer device components 12–18.

Figure 3:
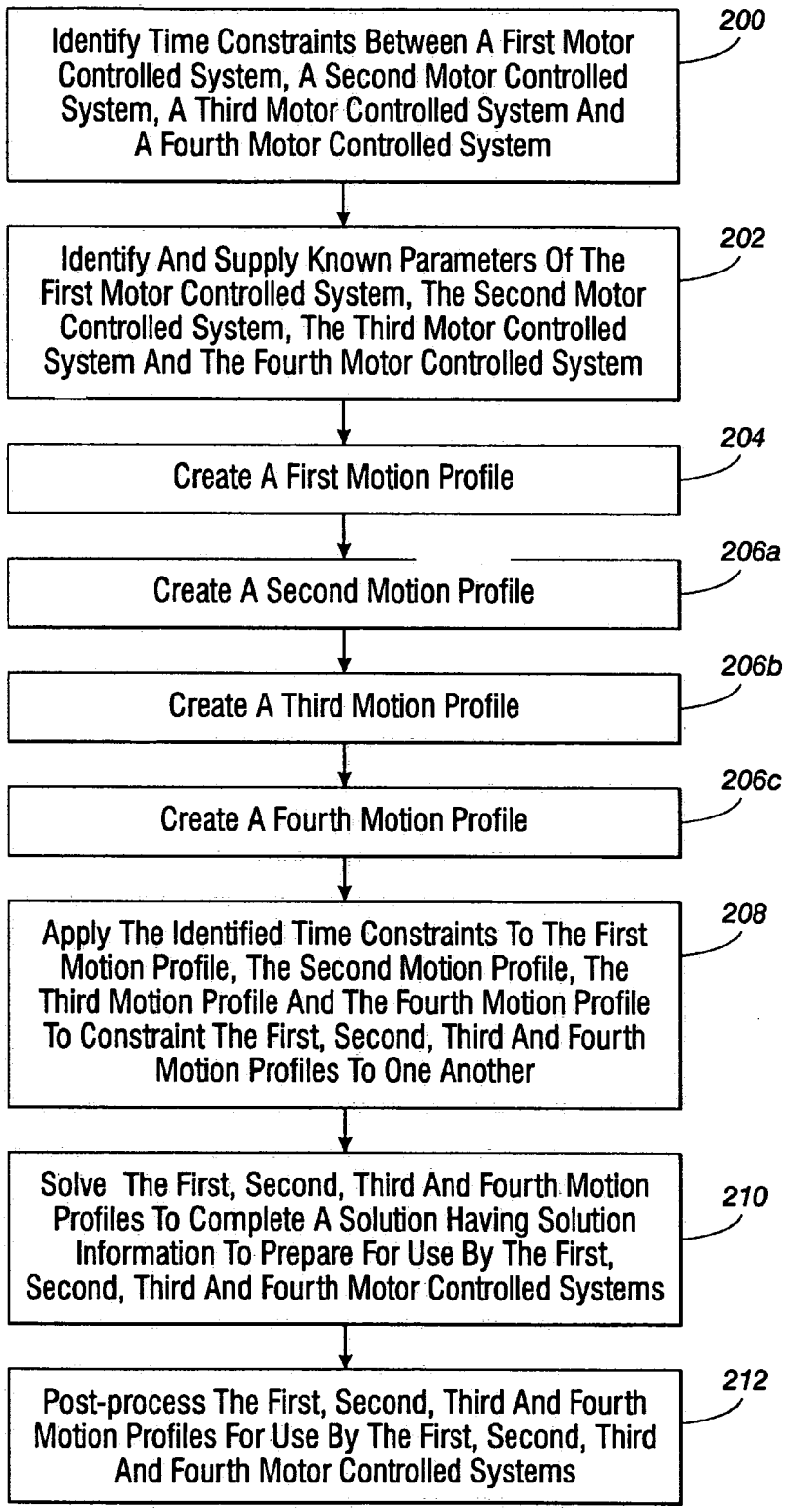
FIG. 3 is a block diagram illustrating a set of processing steps for deriving and implementing motion profiles where at least four motor controlled systems are utilized.
Figure 4:
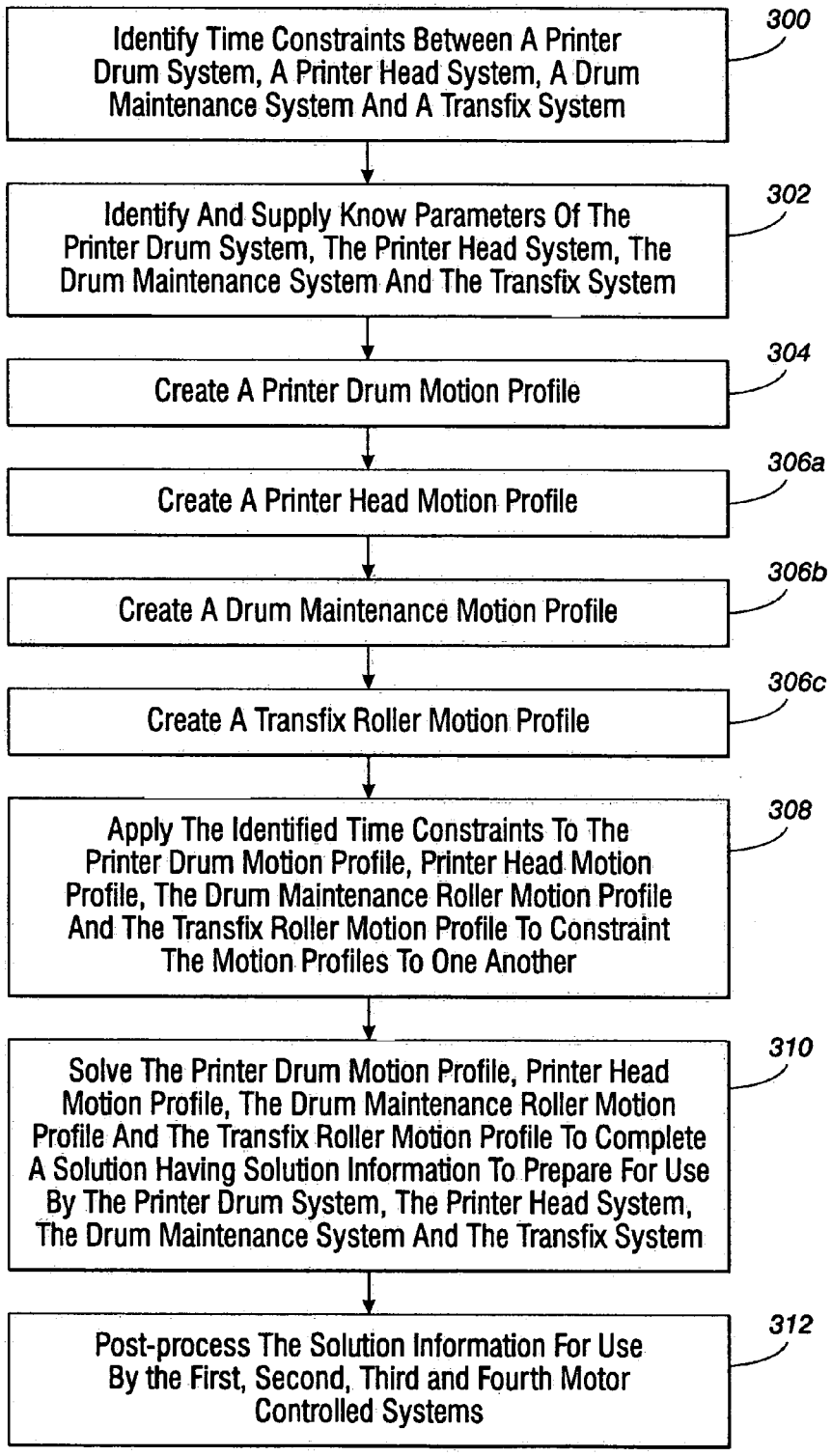
FIG. 4 is a block diagram illustrating a set of processing steps for motion analysis and control in a printer device.

To derive and implement motion profiles for a given automated device, the time constraints between all interrelated motor driven systems in the device must be identified. Thus, with reference to FIG. 2*a*, if the device has at least two interrelated motor controlled systems, the time constraints between a first motor controlled system in the automated device and a second motor controlled system in the automated device are identified (step 100). It is to be understood that the automated device may not have any interrelated motor driven systems in which case step 100 is skipped. With reference to FIG. 3, if the device has at least four interrelated motor controlled systems, the time constraints between the first motor controlled system, the second motor controlled system, the third motor controlled system and the fourth motor controlled system are identified (step 200). With reference to FIG. 4, in the printer device 10, the time constraints between a printer drum system 12,20,22; a printer head system 14,24,26; a drum maintenance system 16,28,30; and a transfix system 18,32,34 are identified.

Next, known parameters of the motor controlled system or systems are identified and supplied. In the automated device having at least two interrelated motor controlled systems, with reference back to FIG. 2*a*, known parameters of the first motor controlled system and the second motor controlled system are identified and supplied (step 102). In the automated device having at least four interrelated motor controlled systems, with reference to FIG. 3, known parameters of the first motor controlled system, the second motor controlled system, the third motor controlled system and the fourth motor controlled system are identified and supplied (step 202). With reference to FIG. 4, in the printer device 10, known parameters of the printer drum system 12,20,22; the printer head system 14,24,26; the drum maintenance system 16,28,30; and the transfix system 18,32,34 are identified and supplied (step 302). For example, known parameters in the printer device could include the distance the printer drum should move during a cleaning operation, the velocity at which the printer drum should move, the actuation distance required for drum maintenance engagement between the drum maintenance roller and the printer drum, and the specific velocity and position at which the printer head and the printer drum need to be at to begin imaging.

Figure 2A:
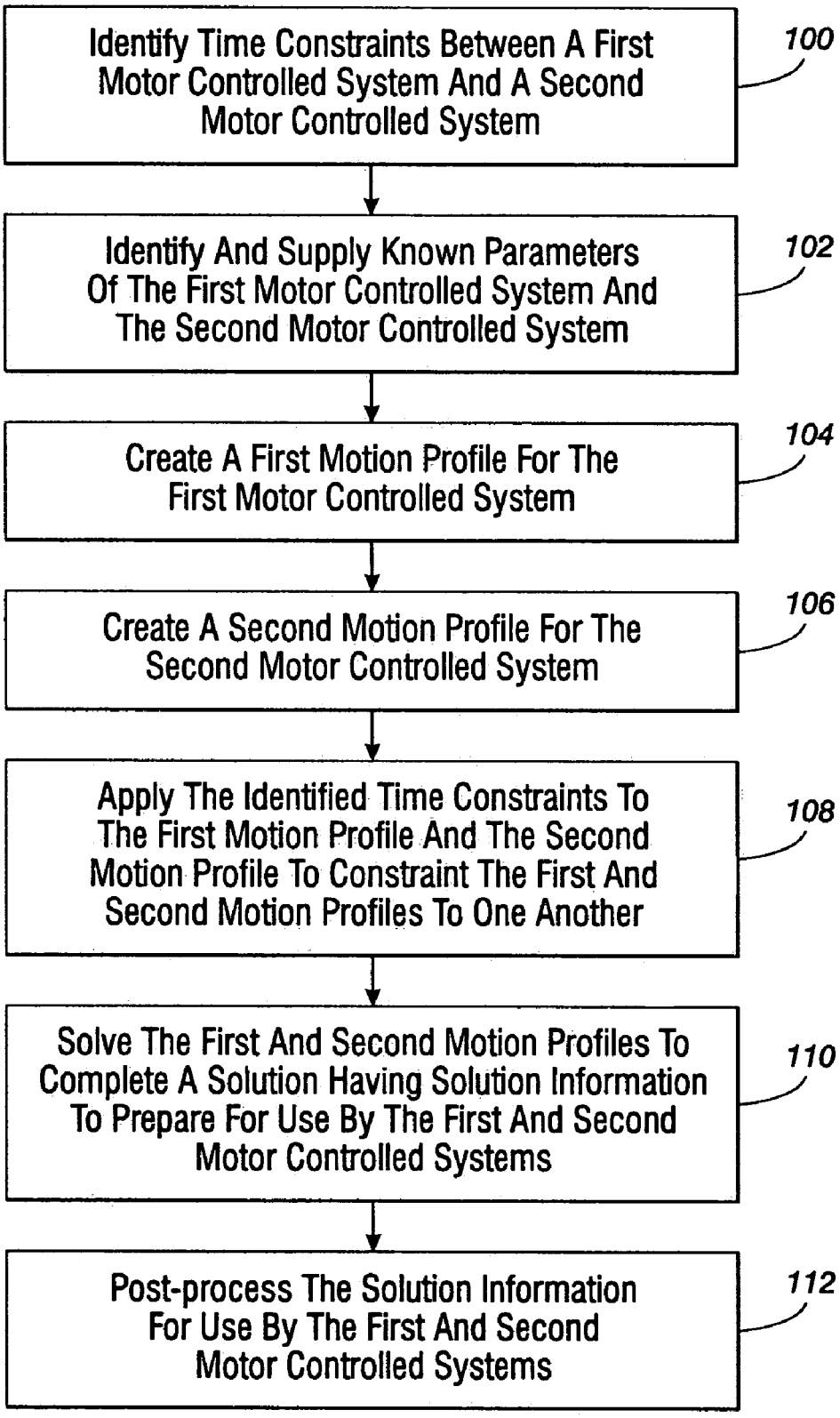
FIG. 2*a* is a block diagram illustrating a set of processing steps for deriving and implementing one or more motion profiles.

With reference to FIG. 2*a*, with the known parameters identified and supplied, a first motion profile is created for the first motor controlled system (step 104). More particularly, according to one embodiment, with reference to FIG. 2*b*, the first motion profile is created by creating a first series of blocks each having block constraints (step 104*a*). Thus, the first motion profile which defines a motion for a first motor of the first motor controlled system is described as an ordered list of blocks. Blocks, as used herein, are the basic term for items that are put together to create a motion profile and, generally, blocks keep track of beginning and ending velocity as well as beginning and ending position. Thus, the first series of blocks keeps track of the beginning and ending velocities and positions of a first motor of the first motor controlled system. For this purpose, each block has block constraints including a position constraint input, a position constraint output, a velocity constraint input and a velocity constraint output. The block constraints define the flow of information between the first series of blocks for at least position and velocity.

Figure 2B:
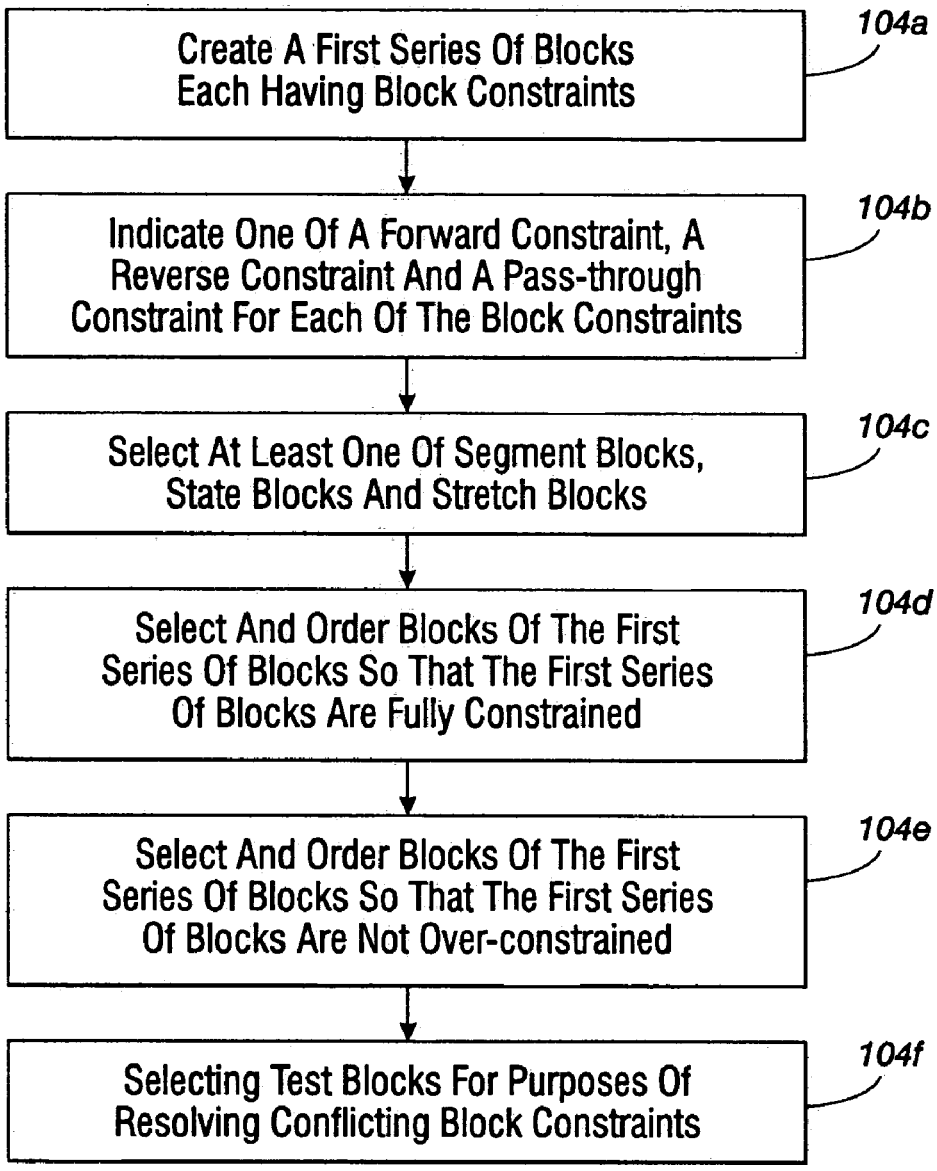
FIG. 2*b* is a block diagram illustrating a set of processing sub-steps for creating a motion profile in accordance with the processing steps illustrated in FIG. 2*a;*
Figure 2C:
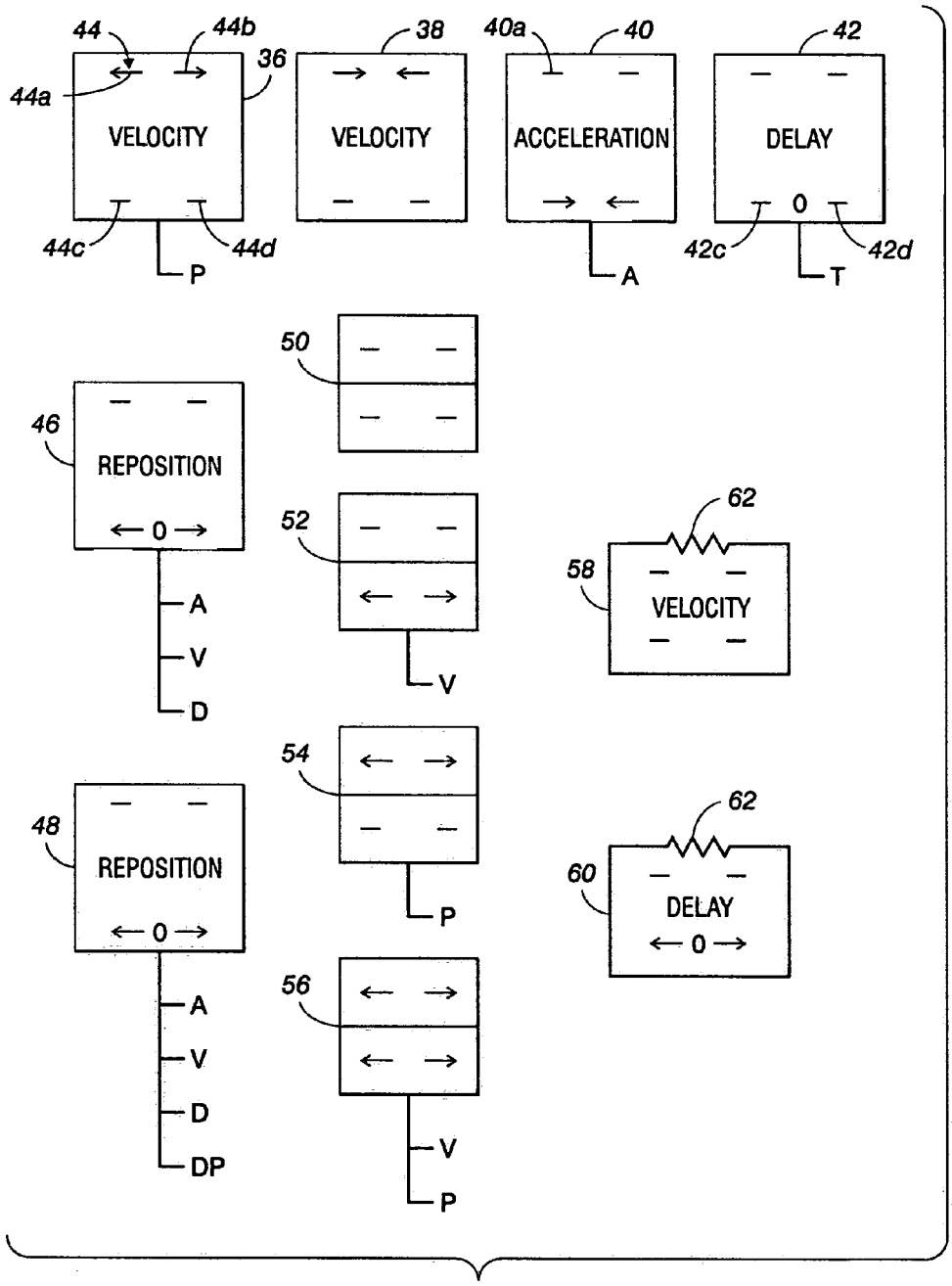
FIG. 2*c* illustrates example blocks for use with the sub-processing steps of FIG. 2*b;*

In written form, according to one embodiment, with reference to FIG. 2*c*, each block in a series of blocks 36,38,40,42 can be illustrated as a rectangular box and the block constraints 44 can be indicated in each of the four corners of the rectangular box. The top left corner of a written block can indicate the position constraint input 44*a*, the top right corner can indicate the position constraint output 44*b*, the lower left corner can indicate the velocity constraint input 44*c* and the lower right corner can indicate the velocity constraint output 44*d*. With reference to FIG. 2*b*, each of the block constraints is indicated as one of a forward constraint, a reverse constraint or a pass-through constraint which define the flow of information between adjacent blocks concerning position and velocity (step 104*b*). With reference to FIG. 2*c*, in written form, the forward constraint can be represented by a forward arrow (see 44*b*), the reverse constraint can be represented by a reverse arrow (see 44*a*) and the pass-through constraint can be represented by a dash (see 44*c* and 44*d*). As will be described in more detail below, the pass-through constraint has its constraint direction determined by its neighboring blocks.

With reference again to FIG. 2*b*, the first series of blocks are created by selecting the following types of blocks: segment blocks, state blocks, and stretchy blocks (step 104*c*). Segment or motion blocks are blocks that have some time duration associated therewith, i.e., segment blocks have some finite duration. State blocks are blocks that have no time duration associated therewith. Stretchy blocks are a variation of a segment block having a variable time duration associated therewith. The blocks of the first series of blocks are selected and ordered so that the first series of blocks are fully constrained (step 104*d*) and not over-constrained (step 104*e*). To avoid over-constraining the first series of blocks, all adjacent block constraints are required to not conflict. For example, if a first block precedes a second block and the first block has an ending position constraint that is a forward constraint, then the second block is required to have a beginning position constraint that is either a forward constraint or a pass-through constraint.

Concerning block types, segment blocks include four basic types: acceleration segment blocks, velocity segment blocks, reposition segment blocks and delay segment blocks. Segment blocks generally describe the shape of a motor motion in a velocity versus time diagram and tend to describe the intent of the motor motion in a fairly generic manner. Acceleration segment blocks take one known parameter which is acceleration. With reference to FIG. 2*c*, block 40 is an example of a written acceleration block and the one known parameter, acceleration, is indicated by the variable A below the block 40. Acceleration segment blocks accelerate between velocity constraints supplied by neighboring blocks at the acceleration known parameter A that is supplied in step 102. Velocity segment blocks, such as block 38, travel at a constant velocity between position constraints (such as constraint 44*b* and constraint 40*a*) supplied by neighboring blocks. Other velocity segment blocks (not shown) could require a known time parameter that indicates a constant velocity movement for the supplied known time parameter or could require a known position parameter that indicates a constant velocity movement until the supplied position parameter is reached. Delay segment blocks, such as block 42, take one known parameter, time, which is indicated by the variable T and require velocity to be zero (0), as indicated by the zero (0) between the velocity constraints 42*c* and 42*d*.

Reposition segment blocks take at least two (2) known parameters, acceleration and velocity, and can optionally include a deceleration known parameter and/or a time known parameter. For example, a reposition segment block 46 taking three (3) known parameters of acceleration A, velocity V and deceleration D represents a reposition move that starts and ends at zero (0) velocity. The three known parameters specify the limits on the move. More particularly, this segment block 46 gets the distance to be traveled from its neighboring blocks, calculates the fastest possible move using the known acceleration and known deceleration parameters while limiting the move to the known velocity parameter. Another example of a reposition segment block is block 48 which takes four (4) known parameters including acceleration A, velocity V, deceleration D and ending position DP. Again, the distance to be traveled comes from its neighboring blocks and, within the block, the fastest possible move using the known acceleration A, deceleration D, maximum velocity V and ending position DP is calculated during the post-processing step described below.

State blocks, such as blocks 50,52,54,56 are used between segment blocks to supply segment blocks with the known parameters needed by the segment blocks. For example, velocity segment block 52 only knows that it should produce a segment of constant velocity. State blocks may be needed adjacent a velocity segment block, such as velocity segment block 38, to supply such information as for the specific value of velocity that the velocity segment block should utilize and for how far should the velocity segment block travel. State blocks can include passive state blocks (such as block 50), velocity state blocks (such as block 52), position state blocks (such as block 54), and velocity and position state bocks (such as block 56). The passive state block 50 has no effect on the block constraints concerned with position and velocity but, rather, provide a location to which an identified time constraint may be applied as will be described in more detail below. The velocity state block 52 constrains velocity to the velocity known parameter V supplied thereto, the position state block 54 constrains position to the position known parameter P supplied thereto and the velocity and position state block 56 constrain velocity and position to the supplied position and velocity known constraints V,P.

Stretchy blocks, such as blocks 58,60, are used for purposes of having a block with a variable time duration. In written form, the blocks 58,60 include a wavy portion 62 to indicate that the blocks are stretchy blocks. Block 58 is a constant velocity segment having a variable duration and block 60 is a delay segment having a constant velocity of zero (0). As will be described in more detail below, stretchy blocks are used in conjunction with the identified time constraints (from step 100) to coordinate motion of the first motor and the precise duration of a stretchy block in a given profile will not be determined until that profile is post-processed.

Figure 2D:
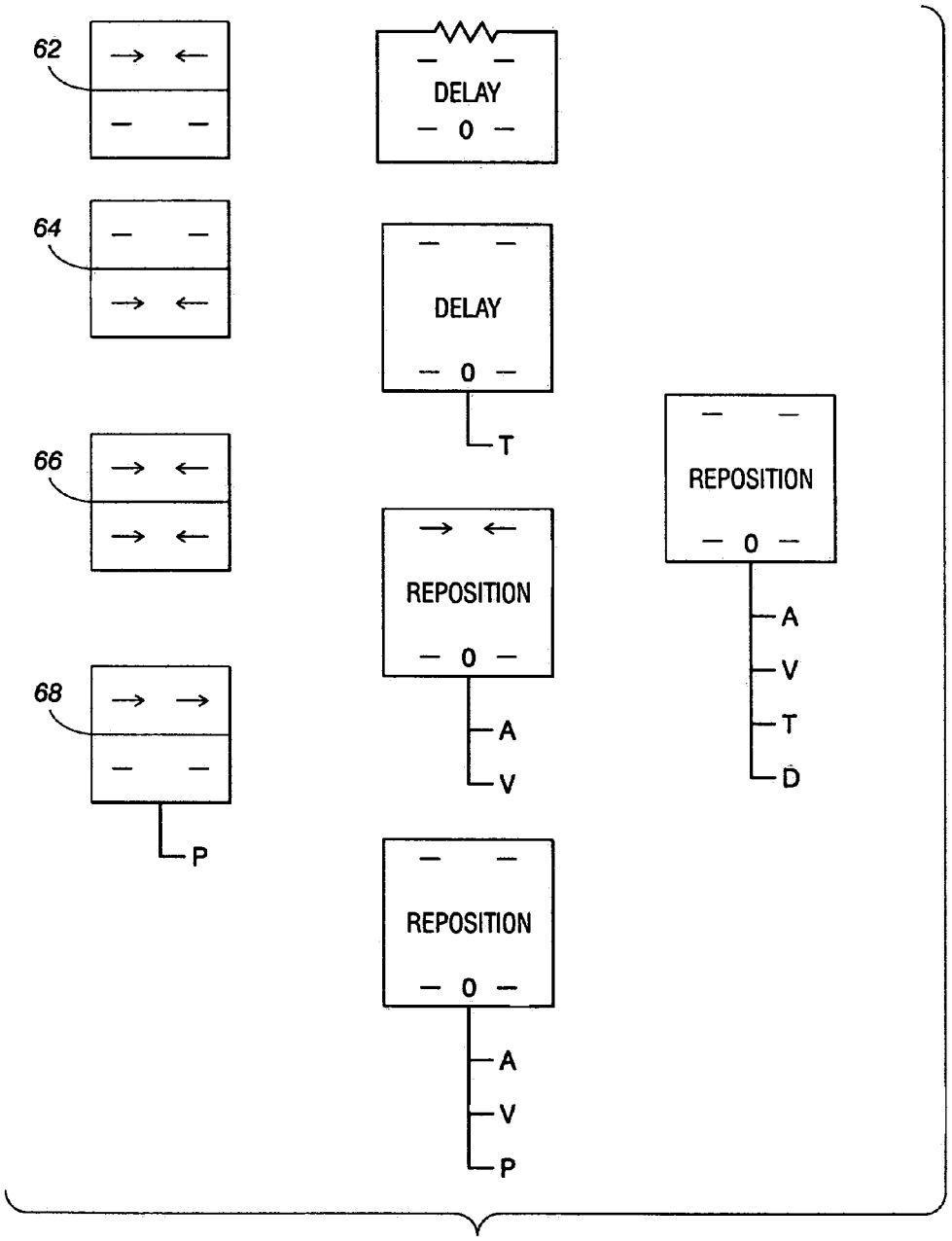
FIG. 2*d* illustrates example blocks for use with the sub-processing steps of FIG. 2*b;*

With reference to FIG. 2*b*, to avoid over-constrained relationships between blocks in the first series of blocks, test blocks can be selected for purposes of resolving conflicting block constraints (step 104*f*). As discussed above, over-constraint occurs when adjacent block constraints are in conflict. For example, with reference to FIG. 2*c*, if block constraint 44*b* were a reverse arrow, it would be in conflict with the beginning position block constraint (upper left corner) of block 38. A test state block eliminates the conflict by testing for the values that each conflicted constraint is attempting to supply. With reference to FIG. 2*d*, examples of test state blocks 62, 64, 66, 68 are shown. Test state block 62 could be used to remove one conflicted position constraint. Test state block 64 could be used to remove one conflicted velocity constraint. Test state block 66 could be used to remove both a conflicted velocity constraint and a conflicted position constraint. Alternately, test state block 68 could be used. Block 68 does not add or remove constraints but, rather, simply resets the value of position in the motion profile to the known parameter supplied or specified by the position parameter P. Test segment blocks can also be used to resolve conflicts between adjacent block constraints. Examples of test segment blocks are illustrated on the right side of FIG. 2*d*. Test segment blocks generally combine the function of a given segment with a test state to provide for frequently used combinations. For example, a reposition segment block has an implied zero (0) velocity. Multiple reposition segment blocks could not be positioned adjacent one another without violating velocity constraints; however, with test reposition segment blocks velocity is equal and, more specifically, equal to zero (0).

Next, a motion profile is created for each motor controlled system that is to be controlled. With reference to FIG. 2*a*, once the first motion profile is created and properly constrained or simultaneously with the creation of the first motion profile, a second motion profile is created for the second motor controlled system (step 106) in the same manner described above in reference to the first motion profile. If the automated device includes only a single motor controlled system it is desirable to only derive a motion profile for a single motor controlled system, step 106 is skipped. With reference to FIG. 3, if four motor controlled systems are being used, first, second, third and fourth motion profiles are created for the first, second, third and fourth motor controlled systems (steps 204, 206*a*, 206*b* and 206*c*). With reference to FIG. 4, in the printer device 10, a motion profile is created for the printer drum system 12,20,22 (step 304); the printer head system 14,24,26 (step 306*a*); the drum maintenance system 16,28,30 (step 306*b*); and the transfix system 18,32,34 (step 306*c*).

Figure 5A:
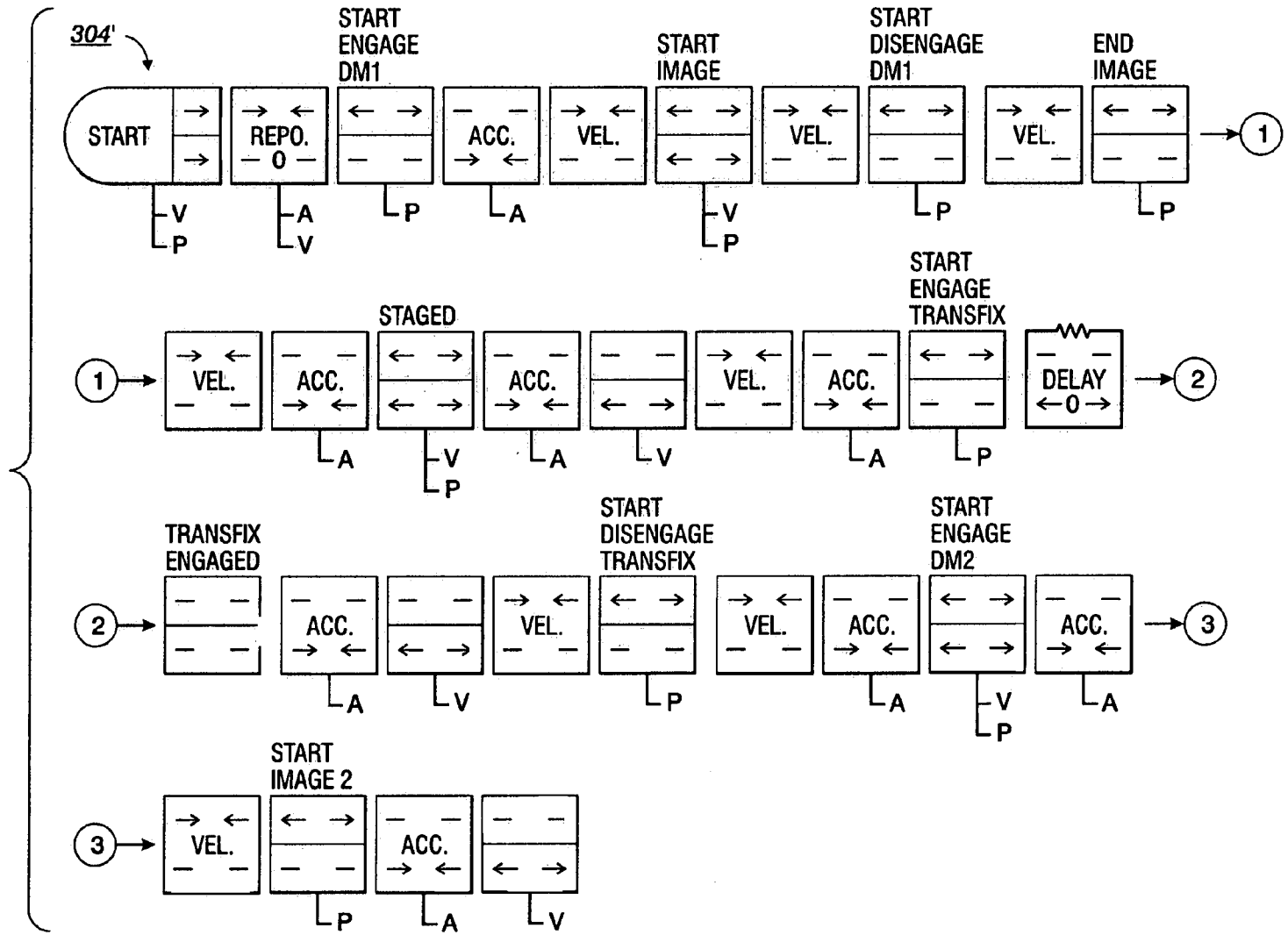
FIG. 5*a* is a partial example of a plurality of motion profiles for use with a printer device.
Figure 5B:
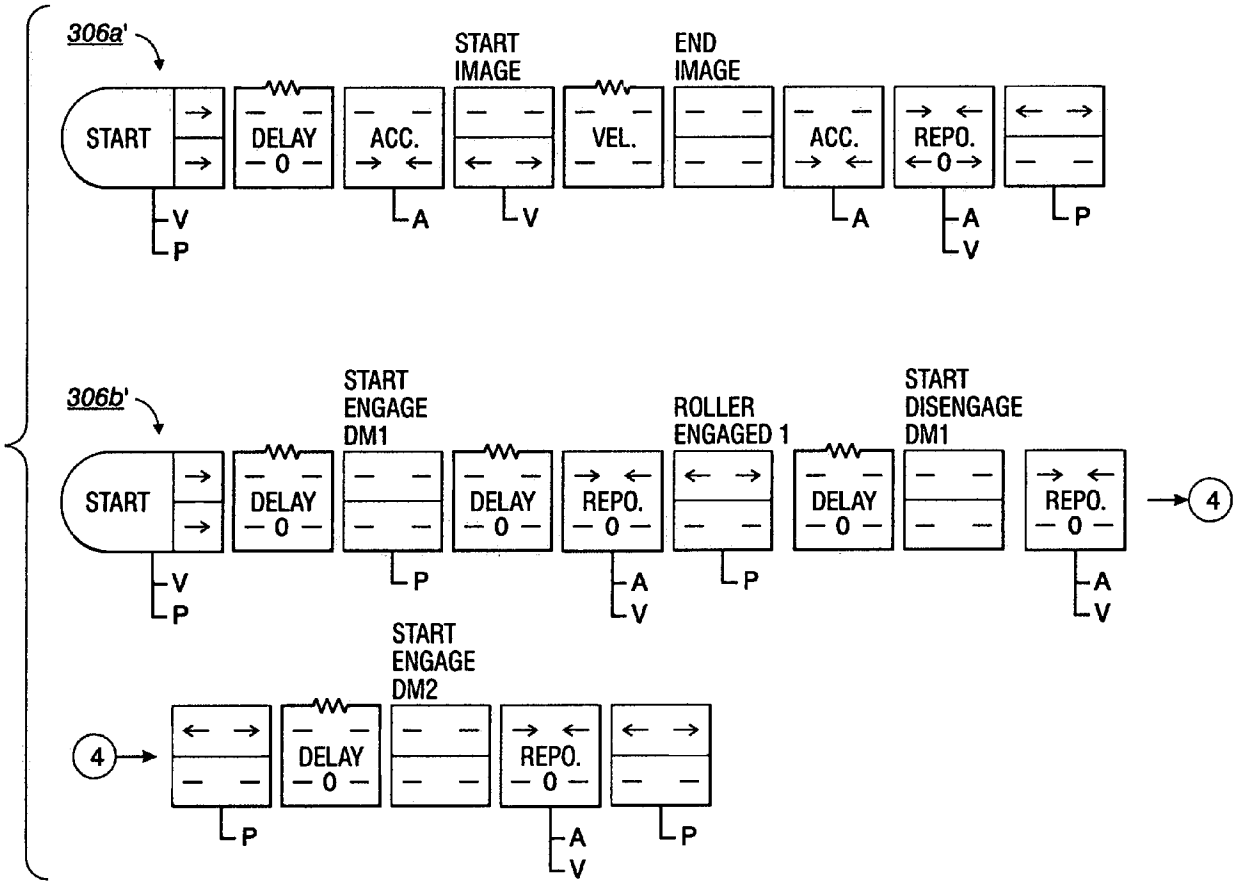
FIG. 5*b* is a continuation of the example of FIG. 5*a*.
Figure 5C:
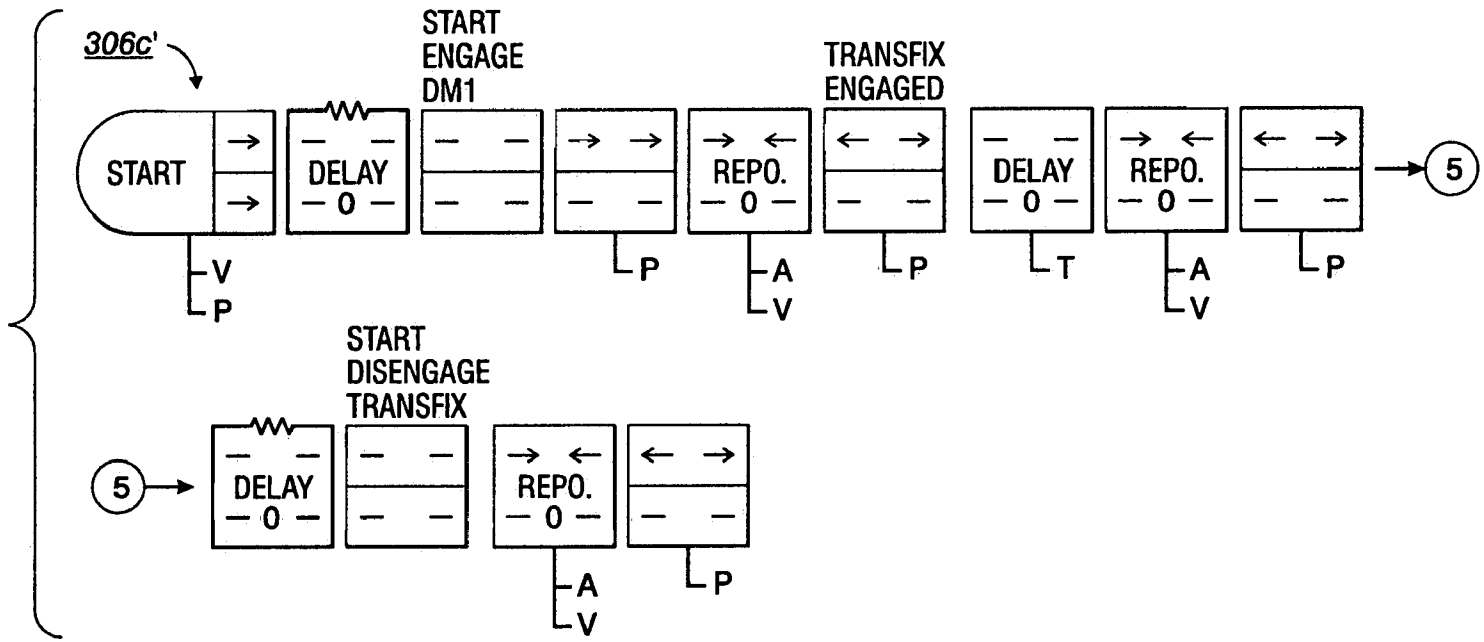
FIG. 5*c* is a further continuation of the example of FIG. 5*a*.

Next, the identified time constraints (from step 100) can be applied to state blocks of the various profiles to constrain the profiles to one another. For example, with reference to FIG. 2*a*, the identified time constraints can be applied to state blocks in the first motion profile and the second motion profile to constrain the first motion profile and the second motion profile to one another (step 108). Of course, if only a single motion profile was created or motion profiles are created for motor controlled systems that are not interrelated, step 108 is skipped. Application of a particular time constraint to state blocks of different motion profiles constrains the motion profiles such that the state blocks with the time constraint applied thereto are to occur simultaneously, or with some fixed delay relative to each other (i.e. one may be constrained to be within a specified period of time relative to the other. Similarly, with reference to FIG. 3, in the four motor controlled system arrangement, time constraints (from step 200) can be applied to state blocks in two or more of the motion profiles (step 208). Likewise, with reference to FIG. 4, in the printer device, time constraints (from step 300) can be applied to the state blocks in the four created motion profiles (step 308). With reference to FIGS. 5*a*–5*c*, motion profiles for each of the systems in the printer device 10 are illustrated in accordance with one embodiment. More particularly, a print drum profile 304', a print head profile 306*a*', a drum maintenance profile 306*b*' and a transfix profile 306*c*' are illustrated and bear reference numerals the same as the sub-steps (see FIG. 4) in which these profiles are created with a prime symbol added to the reference numeral. The time constraints appear as text above various state blocks in each of the motion profiles. For example, a "start image" time constraint is shown in the print drum motion profile and in the printer head motion profile.

With the motion profiles constrained relative to one another, the motion profiles are solved to complete a solution having solution information to prepare for use by their respective motor controlled systems. More particularly, with reference to FIG. 2*a*, the first and second motion profiles are solved for use by the first and second motor controlled systems (step 110). With reference to FIG. 3, the first, second, third and fourth motion profiles are solved for use by said first, second, third and fourth motor controlled systems (step 210). With reference to FIG. 4, the motion profiles for each of the systems in the printer device 10 are solved for use by the printer drum system 12,20,22; the printer head system 14,24,26; the drum maintenance system 16,28,30; and the transfix system 18,32,34 (step 310).

The step of solving can involve using one or more of the created motion profiles in a solver. All motion profiles linked or constrained by time constraints are required to be solved simultaneously. The solver breaks the blocks of each series of blocks of each of the motion profiles down into sub-attributes that may include, without limitation, velocity, position and duration. The solver uses all of the block constraints of the blocks and any constraints inherent within each block to build a dependency tree of equations relating to each sub-attribute. Each sub-attribute is positioned within the tree of equations so as to guarantee that all prerequisite information will be available before the specific sub-attribute is solved. The solver then applies a recursive algorithm to complete a solution for the motion profiles provided the motion profiles are not over-constrained, under-constrained and do not require motors of the one or more the motor controlled systems to violate physics. The solution includes solution information concerning all accelerations, velocities, positions and delays represented by the motion profiles. If the motion profiles are over-constrained, under-constrained and/or require the motors of the one or more motor controlled systems to violate physics, no solution will be found but, instead, errors or problems in the motion profiles will be identified.

The solution information, i.e., the acceleration, velocity, position and delay information for the motion profiles, can then be post-processed (step 112). More particularly, a simulator can post-process the solution or solution information to create one or more timing diagrams corresponding to the one or more motion profiles. For example, the solution to the first and second motion profiles solved in step 110 can be used in the simulator to create a first timing diagram corresponding to the first motion profile and a second timing diagram corresponding to the second motion profile. Alternately, or in addition to post-processing in the simulator, the solution to the motion profiles or the solution information can be post-processed into a form useful to program motor controllers of the motor controlled systems for controlling motors of the motor controlled system.

For example, the first motion profile derived in step 108 can be used in combination with the solution to program a first motor controller of the first motor controlled system for purposes of controlling a first motor of the first motor controlled system. The second motion profile can be used in combination with the solution to program a second motor controller of the second motor controlled system for purposes of controlling a second motor of the second motor controlled system. In the printer device 10, the printer drum profile can be used in combination with the solution to program the printer drum system to control motion of the printer drum, the printer head profile can be used to program the printer head system to control motion of the printer head, the drum maintenance profile can be used to control motion of the drum maintenance roller, and the transfix profile can be used to program the transfix system to control motion of the transfix roller.

According to another embodiment, an apparatus for deriving and implementing one or more motion profiles is provided. The apparatus includes a means for identifying and supplying known parameters of a first motor controlled system and a means for creating a first motion profile for the first motor controlled system. The apparatus also includes a means for solving the first motion profile to complete a solution having solution information and a means for post-processing the solution information for use by the first and second motor controlled system.

According to yet another embodiment, an apparatus for deriving and implementing one or more motion profiles is provided. The apparatus optionally includes a means for identifying at least one time constraint between a first motor controlled system of an automated device and a second motor controlled system of the automated device. Moreover, the apparatus includes a means for identifying and supplying known parameters of the first and second motor controlled systems and a means for creating first and second motion profiles for the first and second motor controlled systems. The apparatus also optionally includes a means for applying said identified at least one time constraining to the first and second motion profiles to constrain the first and second motion profiles to one another, a means for solving the first and second motion profiles to complete a solution having solution information and a means for post-processing the solution information for use by the first and second motor controlled system.

The exemplary embodiment has been described with reference to the embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. A method for motion analysis and control in a printer device, comprising the steps of:

identifying time constraints between a printer drum system and a printer head system;

identifying and supplying known parameters of said printer drum system and said printer head system;

creating a printer drum profile and a printer head profile;

applying the identified time constraints to the printer drum profile and the printer head profile to constrain the printer head profile to the printer drum profile;

using said printer drum profile to program said printer drum system to control motion of a printer drum of said printer drum system; and using said printer head profile to program said printer head system to control motion of said printer head of said printer head system.

2. The method of claim 1 wherein said step of using said printer drum profile to program said printer drum system includes the sub-step of solving said printer drum profile using a recursive algorithm.

3. The method of claim 1 wherein said step of using said printer head profile to program said printer head system includes the sub-steps of:

solving said printer head profile using a recursive algorithm;

repairing said printer head profile if said recursive algorithm indicates an error; and providing one of an output and a solution order to said printer head profile for programming a controller of said printer head system to control motion of said printer head.

4. A method for motion analysis and control in a printer device comprising the steps of:

identifying time constraints between said printer drum system, said printer head system, a drum maintenance system and a transfix system;

identifying and supplying known parameters of said printer drum system and said printer head system;

identifying and supplying known parameters of said drum maintenance system and said transfix system;

creating a printer drum profile and a printer head profile;

creating a drum maintenance profile and a transfix profile;

using said printer drum profile to program said printer drum system to control motion of a printer drum of said printer drum system; and using said printer head profile to program said printer head system to control motion of said printer head of said printer head system:

using said drum maintenance profile to program said drum maintenance system to control motion of a drum maintenance roller of said drum maintenance system; and using said transfix profile to program said transfix system to control motion of a transfix roller of said transfix system.

5. A apparatus for deriving and implementing one or more printer device motion profiles, comprising:

a means for identifying at least one time constraint between a first motor controlled system of a printer device and a second motor controlled system of the printer device;

a means for identifying and supplying known parameters of said first motor controlled system and said second motor controlled system;

a means for creating a first motion profile for said first motor controlled system and a second motion profile for said second motor controlled system;

a means for applying said identified at least one time constraint to said first and second motion profiles to constrain said first and second motion profiles relative to one another;

a means for solving said first and second motion profiles to complete a solution having solution information; and a means for post-processing said solution information for use by said first and second motor controlled systems.

6. The apparatus of claim 5 wherein said first motor controlled system is a printer drum system and said second motor controlled system is a printer head system.

7. A method for deriving and implementing one or more motion profiles of a printer device, comprising the steps of:

identifying at least one time constraint between a printer drum system in a printer device and a printer head system in said printer device;

identifying and supplying known parameters of said printer drum system and said printer head system;

creating a first motion profile for said printer drum system;

creating a second motion profile for said printer head system;

applying said identified at least one time constraint to said first and second motion profiles to constrain the first and second motion profiles to one another; and solving said first and second motion profiles to complete a solution having solution information to prepare for use by said printer drum and printer head systems; and post-processing said solution information for use by said printer drum and printer head systems.

8. The method of claim 7 wherein said first motor controlled system is a printer drum system and said second motor controlled system is a printer head system.

9. A method for deriving and implementing one or more motion profiles of a printer device, comprising the steps of:

identifying at least one time constraint between a first motor controlled system in a printer device and a second motor controlled system in said printer device;

identifying and supplying known parameters of said first motor controlled system and said second motor controlled system;

creating a first motion profile for said first motor controlled system;

creating a second motion profile for said second motor controlled system;

applying said identified at least one time constraint to said first and second motion profiles to constrain the first and second motion profiles to one another; and solving said first and second motion profiles to complete a solution having solution information to prepare for use by said first and second motion controlled systems; and post-processing said solution information for use by said first and second motor controlled systems.

10. The method of claim 9 wherein said step of creating said first motion profile includes the sub-step of creating a first series of blocks each having block constraints including a position constraint input, a position constraint output, a velocity constraint input and a velocity constraint output.

11. The method of claim 10 wherein said sub-step of creating a first series of blocks includes the sub-step of indicating one of a forward constraint, a reverse constraint and a pass-through constraint for each of said block constraints to define the flow of information between adjacent blocks for velocity and position.

12. The method of claim 10 wherein said sub-step of creating said first series of blocks includes the sub-step of selecting at least one of segment blocks, state blocks and stretchy blocks for said first series of blocks wherein said segment blocks have a fixed time duration associated therewith, said state blocks have no time duration associated therewith, and said stretchy blocks have a variable time duration associated therewith that is determined during the step of post-processing said first and second motion profiles in conjunction with said time constraints.

13. The method of claim 10 wherein said sub-step of selecting at least one of segment blocks, state blocks and stretchy blocks includes the sub-step of selecting and ordering blocks so that said first series of blocks are fully constrained.

14. The method of claim 13 wherein said sub-step of selecting at least one of segment blocks, state blocks and stretchy blocks includes the sub-step of selecting and ordering blocks so that said first series of blocks are not over-constrained.

15. The method of claim 10 wherein the sub-step of selecting at least one of segment blocks, state blocks and stretchy blocks includes the sub-step of selecting test blocks for purposes of resolving conflicting block constraints.

16. The method of claim 9 wherein said sub-step of solving said first and second motion profiles includes the sub-steps of:

using said first and second motion profiles in a solver that applies a recursive algorithm to at least one of (1) identify problems in said first and second motion profiles and (2) complete said solution to said first and second motion profiles.

17. The method of claim 16 wherein the sub-step of using said first and second motion profiles in a solver includes the sub-steps of:

breaking down blocks of the motion profiles into sub-attributes;

using block constraints of said blocks and constraints inherent in said blocks to build a dependency tree of equations relating to each sub-attribute;

positioning each end-attribute within said tree of equations; and applying said recursive algorithm to complete said solution.

18. The method of claim 9 wherein said step of post-processing includes the sub-step of:

using said solution in a simulator to create a first timing diagram corresponding to said first motion profile and a second timing diagram corresponding to said second motion profile.

19. The method of claim 9 wherein said step of post-processing includes the sub-steps of:

using said solution profile to program a first motor controller to control a first motor of said first motor controlled system and a second motor controller to control a second motor of said second motor controlled system.

* * * * *